US010060299B2

(12) United States Patent
Al Ghizzy

(10) Patent No.: US 10,060,299 B2
(45) Date of Patent: Aug. 28, 2018

(54) THERMO-ELEVATION PLANT AND METHOD

(71) Applicant: Husham Al Ghizzy, Anaheim, CA (US)

(72) Inventor: Husham Al Ghizzy, Anaheim, CA (US)

( * ) Notice: Subject to any disclaimer, the term of this patent is extended or adjusted under 35 U.S.C. 154(b) by 820 days.

(21) Appl. No.: 14/490,234

(22) Filed: Sep. 18, 2014

(65) Prior Publication Data

US 2016/0084114 A1 Mar. 24, 2016
US 2018/0003084 A9 Jan. 4, 2018

Related U.S. Application Data

(60) Provisional application No. 61/960,462, filed on Sep. 19, 2013.

(51) Int. Cl.
*F01K 23/04* (2006.01)
*F01K 25/08* (2006.01)
*F01K 7/16* (2006.01)

(52) U.S. Cl.
CPC ..... *F01K 23/04* (2013.01); *F01K 7/16* (2013.01); *F01K 25/08* (2013.01)

(58) Field of Classification Search
CPC .... F02C 6/14; F03G 3/00; F25B 11/00; F25B 2400/14; F01K 25/106; F24F 5/0042; F02G 1/043; F02G 2280/20
See application file for complete search history.

(56) References Cited

U.S. PATENT DOCUMENTS 3,953,971 A * 5/1976 Parker ..... F03G 7/04 165/45
4,028,079 A * 6/1977 Scheibel ..... F25B 7/00 62/335
4,142,108 A * 2/1979 Matthews ..... F03G 7/04 290/1 R
4,244,189 A 1/1981 Bliamptis
4,315,402 A * 2/1982 Sadhukhan ..... F01K 21/005 60/641.3

(Continued)

FOREIGN PATENT DOCUMENTS

EP 2677253 A1 * 12/2013 ..... F25B 11/00

OTHER PUBLICATIONS

BrightSource's Commitment to Reducing Water Use Through Dry Cooling; Bright Source Limitless; http://brightsourcenergy.comhttp://www.brightsourceenergy.com/stuff/contentmgr/files/0/5a6bf289d056bfb79dca9bd1136ef23f/folder/dry_cooling_faq_july_2012.pdf, printed on Sep. 15, 2014, 2 pages.
How it works: Water for Power Plant Cooling ; Union of Concerned Scientists; http://www.ucsusa.org/clean_energy/our-energy-choices/energy-and-water-use/water-energy-electricity-cooling-power-plant.html; printed on Sep. 15, 2014; 2 pages.

(Continued)

*Primary Examiner* — Mark Laurenzi
*Assistant Examiner* — Shafiq Mian
(74) *Attorney, Agent, or Firm* — Fish & Richardson P.C.

(57) ABSTRACT

In some aspects, a thermal elevation system includes a base plant including an evaporator to vaporize a working fluid. A lift conduit is coupled to the base plant and includes multiple lift stages to lift the working fluid in the vapor state. An elevated plant is coupled to the lift conduit and condenses the working fluid at the elevated plant. A power generation conduit is coupled to the elevated plant and flows the working fluid through multiple power generator stages that each generate electrical power. The working fluid may return to the base plant for recirculation.

16 Claims, 8 Drawing Sheets

(56) References Cited

U.S. PATENT DOCUMENTS

| | | | | |
|---|---|---|---|---|
| 5,873,249 | A * | 2/1999 | Alkhamis | F02C 6/14 60/639 |
| 6,089,028 | A * | 7/2000 | Bowen | F01K 25/10 62/50.2 |
| 6,434,942 | B1 | 8/2002 | Charlton | |
| 8,733,103 | B2 * | 5/2014 | Paya Diaz | F03G 6/00 60/641.6 |
| 2002/0005042 | A1 * | 1/2002 | Alkhamis | F02C 6/14 60/641.1 |
| 2003/0150403 | A1 * | 8/2003 | Bharathan | F01K 25/06 122/5 |
| 2005/0126170 | A1 | 6/2005 | Litwin | |
| 2010/0243016 | A1 * | 9/2010 | Awashima | F01K 25/10 136/205 |
| 2011/0083437 | A1 * | 4/2011 | Ast | F01K 7/025 60/671 |
| 2013/0213040 | A1 * | 8/2013 | Goswami | F01K 7/22 60/647 |
| 2014/0245756 | A1 * | 9/2014 | Morgan | F02C 1/04 62/50.1 |
| 2015/0083180 | A1 * | 3/2015 | Lang | H01L 35/30 136/207 |

OTHER PUBLICATIONS

Ivanpah Solar Power Facility—Wikipedia, http://en.wikipedia.org/wiki/Ivanpah_Solar_Power_Facility printed on Sep. 15, 2014, 4 pages.

Ivanpah Solar Electric Generating Systems (SEGS); https://www.google.com/search?newwindow=1&q=ivanpah+&oq=ivanpah+&gs_l=serp.12..35i3912j0i20j012j0i20j014.4657.4657.0.8351.1.1.0.0.0.0.187.187.0j1.1.0.ekp%2Ckpns%3D1000%2Ckpnr%3D120...0...1.1.46.serp..0.1.187.d0NbpYAKbMc; printed on Sep. 15, 2014; 4 pages.

Joule heating—Wikipedia; http://en.wikipedia.org/wiki/Joule_heating; printed on Sep. 15, 2014; 5 pages.

Lapse-rate—Wikipedia; http://en.wikipedia.org/wiki/Lapse_rate, printed on Sep. 15, 2014, 8 pages.

Nearly Half of U.S. Power Plants Don't Reuse Water; http://spectrum.ieee.org/energywise/energy/fossil-fuels/nearly-half-of-us-power-plants-dont-resuse-water . . . printed on Sep. 15, 2014, 4 pages.

Thermoelectric Power Water Use; the USGS Water Science School, http://water.usgs.gov/edu/wupt.html ; printed on Sep. 15, 2014, 4 pages.

* cited by examiner

THERMO-ELEVATION PLANT AND METHOD

BACKGROUND

The following description relates to efficiently producing power.

Systems for generating power using available elevation and temperature differences have been proposed. Such systems circulate a fluid and generate power using the fluid. An extended elevation rise and drop may be used to drive a generator at a base level using gravitational energy of the fluid.

SUMMARY

In a general aspect, a thermo-elevation plant can produce power efficiently by lifting and generating power in stages. The thermo-elevation plant may use waste heat from a thermoelectric power station or energy from a power source to heat, vaporize and/or lift a working fluid and store the fluid at an elevated level for power generation. Thus, power may be efficiently produced and/or waste heat, electricity or other energy converted to gravitational potential energy for power generation when needed.

In some aspects, a thermal elevation system includes a base plant having an evaporator configured to vaporize a working fluid to a vapor state. A lift conduit is coupled to a lift conduit having a plurality of lift stages. Each lift stage is configured to lift the working fluid in the vapor state. An elevated plant is located higher in elevation than the base plant. The elevated plant has a condenser configured to condense the working fluid from the vapor state to a liquid state. A power generation conduit includes a plurality of power generation stages. Each power generation stage is configured to generate electrical power using working fluid down-flowing from the elevated plant to the base plant.

In some aspects, the evaporator may be included to vaporize the working fluid. The lift stages may each have a thermal heater to heat the working fluid and a vapor pump to move the working fluid upwardly in the lift conduit in the vapor state. One or more of the lift stages may be coupled to one or more of the power generation stages with the lift stages using waste heat generated by the power stages for heating the working fluid in the lift stages.

In some aspects, the condenser may include a coil and a fan configured to condense the working fluid. A compressor may be coupled to the condenser to compress the working fluid to aid condensation in the condenser. The power generation conduit may include a penstock and a power generator having a turbine driven by flowing working fluid and an electric generator coupled to the turbine. The working fluid may be a fluorocarbon or other fluid with, for example, a low boiling point, a low heat of evaporation, and that is heavier than water.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
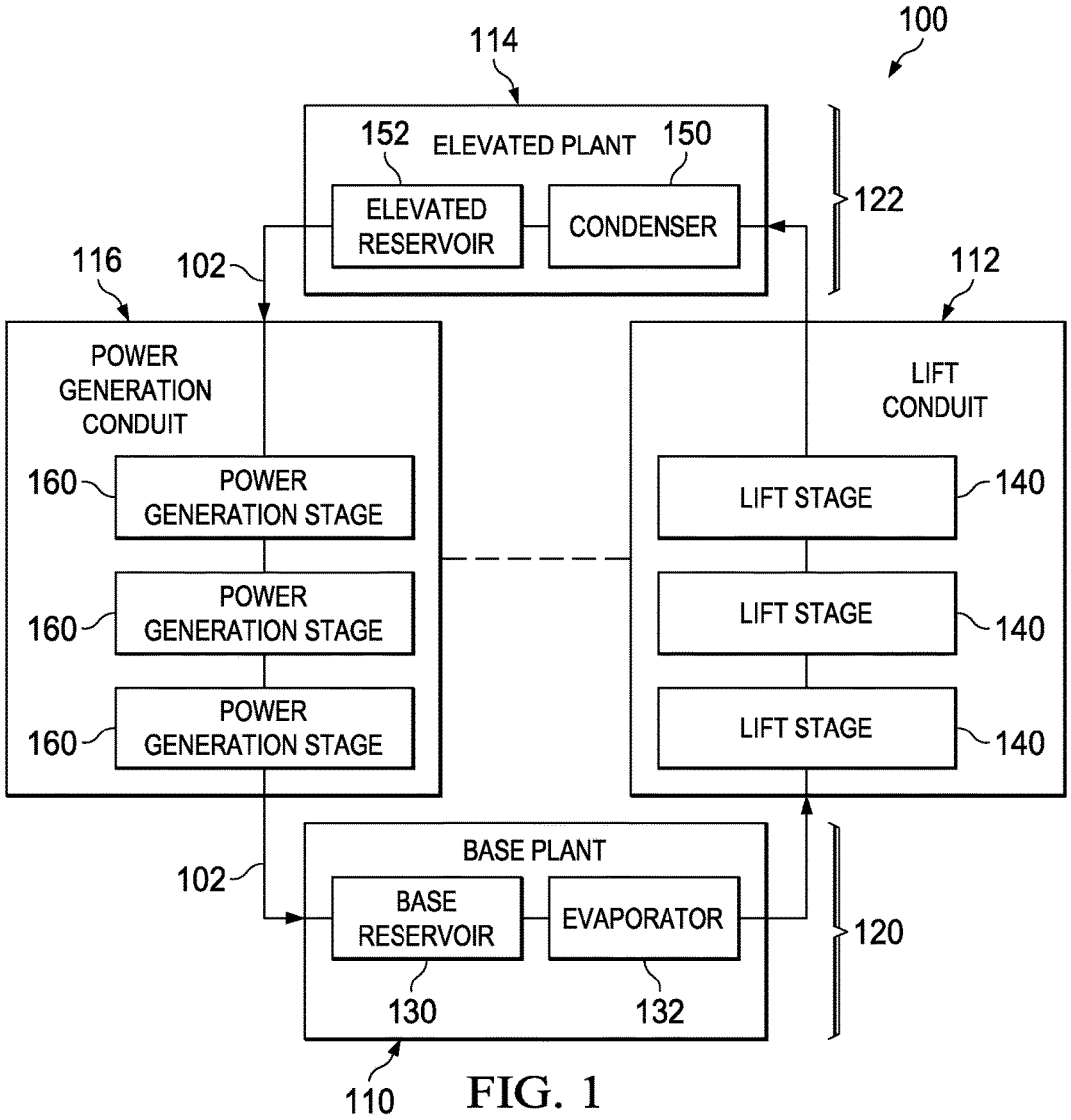
FIG. 1 is a schematic diagram of a thermo-elevation plant in accordance with one aspect of the disclosure.

FIG. 1 illustrates a thermo-elevation plant 100 in accordance with one aspect of the disclosure. The thermo-elevation plant 100 uses elevation and/or atmospheric changes to efficiently circulate a working fluid 102 and generate power. The working fluid is a fluid that may transform between liquid and gas states and absorbs and/or transmits energy as circulated in the thermo-elevation power plant 100. The thermo-elevation plant 100 may also utilize non-carbon heat sources to efficiently operate. The non-carbon heat sources may comprise, for example, waste heat from industrial processes such as a solar power station, a thermoelectric power station and/or solar energy. Thus, the thermo-elevation plant 100 may take advantage of one or more of natural elevations, gravitation energy, abundant solar or waste energy, temperature and pressure atmospheric variations, and phase transitions of the working fluid 102 in combination to efficiently produce and store energy. The thermo-elevation plant 100 may also be used to transfer fluid from ground level over an obstacle or barrier such as a mountain.

The thermo-elevation plant 100 may be sited fully or partially on a geographic feature with elevation variation such as, for example, the side or wall of a hill, mountain, massif, ridge, cliff, valley or trench, or channel. In this aspect, a base level may be located at a lower level or elevation of the feature with an elevated level located at a higher elevation or level of the feature so that a circulating working fluid 102 will flow with gravitational forces from the elevated level to the base level. The base and elevated levels may be at a bottom and a top of the feature, respectively, or at other locations of the feature. Thus, the working fluid 102 will have a higher gravitational potential energy at the elevated level than at the base level. In some aspects, the elevation variation may be a hundred, hundreds, a thousand or thousands of feet. For example, a mountain several thousand to over ten thousand feet in elevation variation may be used. The thermo-elevation plant 100 may, in another aspect of the disclosure, be sited partially on a man-made structure such as, for example, a building or tower with elevation variation.

The working fluid 102 may be any fluid operable, enabled, adapted or otherwise configured to be lifted from the base level to the elevated level and to drive power generation in moving from the elevated level to the base level. In some aspects of the disclosure, the working fluid 102 may be efficiently vaporized at the base level and/or compressed at the elevated level. The working fluid 102 may be, for example, water or a refrigerant. The refrigerant may comprise a substance or mixture, usually a fluid, which undergoes phase transitions from a liquid to a gas, and back again. For example, the refrigerant may comprise fluorocarbons and non-halogenated hydrocarbons and other suitable fluids. The refrigerant may have favorable thermodynamic properties, be noncorrosive to mechanical components, and be safe, including free from toxicity and flammability and not cause ozone depletion or climate change. The working fluid 102 may be selected based on elevation rise of the vapor lift and/or climate. In one aspect of the disclosure, a low temperature working fluid may be used. The working fluid 102 may be recirculated losslessly or with any losses replenished with makeup fluid.

Referring to FIG. 1, the thermo-elevation plant 100 may comprise a base plant 110, a lift conduit 112, an elevated plant 114 and a power generator, or generation, conduit 116. A plant comprises a place where one or more industrial processes take place. Elements of a plant may be distributed from one another. A conduit is a structure or combination of structures and elements used to move, transmit, distribute, send or convey a thing from one place to another. For example, a conduit may comprise a pipe or series of pipes linked together with intermediate elements such as fans, thermal heaters and valves for moving and controlling flow of the working fluid 102 in a pipe. A conduit may be pressurized or unpressurized, insulated or uninsulated, and may be thermally treated or not treated. The base plant 110, the lift conduit 112, the elevated plant 114 and the power generation conduit 116 may be directly connected in sequence or otherwise coupled to communicate between elements.

Working fluid 112 is circulated from the base plant 110, through the lift conduit 112, to the elevated plant 114, and through the power generation conduit 116. The working fluid 102 returns to the base plant 110 and may be recirculated or output for other use.

The base plant 110 may be located at a base level 120, and the elevated plant 114 at an elevated level 122. The base and elevated levels 120 and 122 may each comprise an elevation range. As used herein, each means at least one of the identified elements. Thus, the equipment of the base plant 110 may be located at the same or different elevations. Similarly, the equipment of the elevated plant 114 may be located at the same or different elevations. Typically, but not necessarily, the equipment of the base plant 110 may be co-located on a pad, in one or more structures such as buildings, or otherwise in relative close proximity for efficient operation. Similarly, the equipment of the elevated plant 114 may be co-located on a pad, in one or more structures such as buildings, or otherwise in relative close proximity for efficient operation.

The base plant 110 may comprise a base reservoir 130 and an evaporator 132 connected or otherwise coupled together. The base reservoir 130 may be a natural or artificial source of working fluid 102. For example, the base reservoir 130 may comprise one or a plurality of receptacles or stores such as tanks for receiving and/or storing working fluid 102 from the power generation conduit 116 for recirculation in the thermo-elevation plant 100. The working fluid 102 may be temporarily stored in the base reservoir 130 until needed for lift to the elevated plant 114. The working fluid 102 may flow continuously or may flow during certain times such as off-hours for power generation such as at night to allow power generation during on-hours such as during the day. The base reservoir 130 may be pressurized or unpressurized, insulated or uninsulated, and thermally treated or not treated.

The evaporator 132 is configured to evaporate the working fluid 102. In one aspect of the disclosure, the evaporator 132 uses waste heat from another industrial process or solar power to evaporate the working fluid 102. In other aspects, the evaporator 132 may use energy, which may be surplus or otherwise unused energy, from a renewable energy or other source such as a solar power station. In these aspects, the thermo-elevation plant 100 may be paired, attached or otherwise coupled to a renewable or other power source to efficiently store produced energy as gravitational potential energy for later use. As a result, energy produced during a sunny day (solar)) may be stored if not immediately needed. Ambient temperature may be used with some working fluids 102. In the evaporator 132, the working fluid 102 is vaporized and gains latent heat and temperature for lifting. The selection and design of the evaporator 132 may be based on the working fluid 102, the heat source of the evaporator 132, and/or the climate.

Heating and/or state transformation of the working fluid 102 at the base plant 110 may be aided by atmospheric temperature and pressure variations at the base level 120 compared to the elevated level 122. For example, if the base level 120 is at a mountain bottom it will generally be warmer and at a higher level than an associated elevated level 120 at the mountain top several thousand feet higher in elevation.

The lift conduit 112 may comprise one or a plurality of lift stages 140 connected or otherwise coupled together. A stage may comprise a point, period, or step in a process. The lift stages 140 may each be configured to heat and lift the working fluid 102 vapor from a bottom of the stage 140 to the top of the stage 140. In accordance with one aspect of the disclosure, some or all of the lift stages 140 may use waste heat from the power generation in the power generation conduit 116 to heat the rising working fluid 102. Some or all of the lift stages may instead be powered by solar or other power. Lift stage 140 length may be dependent on the working fluid, the elevation rise and/or the power generation stages.

The elevated plant 114 may comprise a condenser 150 and an elevated reservoir 152 connected or otherwise coupled together. The condenser 150 is configured to reject heat and/or condense the working fluid 102 from a vapor, or gaseous, state to a liquid or other suitable state. In one aspect of the disclosure, the condenser 150 cools the working fluid 102. Cooling and/or state transformation of the working fluid 102 at the elevated plant 114 may be aided by atmospheric temperature variations at the elevated level 122 compared to the base level 120. For example, if the elevated level 122 is on a mountain top at several thousand feet it will be generally cooler than an associated base level 120 at the mountain bottom several thousand feet lower in elevation.

The elevated reservoir 152 may comprise one or a plurality of receptacles or stores such as tanks configured to receive and/or store the working fluid 102 from the condenser 150 for circulation to the power generation conduit 116 in the thermo-elevation power plant 100. The elevated reservoir 152 may be pressurized or unpressurized, insulated or not insulated, and thermally treated or not.

The elevated reservoir 152 may store the working fluid 102 until needed for power generation. Thus, the thermo-elevation cycle may or may not be continuous. For example, the thermo-elevation plant 100 may lift working fluid 102 during off-hours and generate power during on or peak hours.

The power generation conduit 116 may comprise one or a plurality of power generator, or generation, stages 160 connected or otherwise coupled together. Multiple power generation stages 160 may be used to limit the pressure on and cost of the power generation equipment. The power generation conduit 116 is configured to generate power using flowing fluid. In the power generation conduit 116, the working fluid 102 flows or falls through successive power generation stages 160 from the elevated plant 114 to the base plant 110. The power generation stages 140 may be pressurized or unpressurized, insulated or uninsulated, and/or thermally treated or not treated. In one aspect, the power generation stages 160 may be co-located, located next to, or located proximate to one, a plurality or all the lift stages 140. In these and other aspects, the one, a plurality or all the power generation stages 140 may each be coupled to lift stages 140 and, as described in more detail below, waste heat and/or power may be shared between the power generation stages 160 and the lift stages 140.

In one aspect of the disclosure, the power generation stages 160 may successively generate power without outside added heat or thermal treatment of the working fluid 102, with substantially all the thermal treatment outside the power generation conduit 116 and/or in the base plant 110 and lift conduit 112, or with thermal treatment after one or a plurality of the power generation stages 160 or the lowest power generation stage 160. Thus, thermal treatment of the working fluid 102 may take place at the base plant 110 after power generation to allow the thermo-elevation plant 100 to harness hydro or hydraulic pressure before use of thermal energy. The lengths of the power generation stages 160 may be based on, for example, terrain, the working fluid 102, the turbine and generator design, and critical pressures. Thus, the power generation stages 160 may have different lengths and generate different amounts of electricity. From the power generation conduit 116, the working fluid 102 may return to the base plant 110 to be recirculated.

Power lines may be connected to the power generation stages 160 to carry electricity for use. Step-up and step-down transformers may provide electricity and/or power components of the system. The power extracted from the working fluid may depend on the volume, the state, and on the difference in height between the source for a power generator (which may be the outflow of the preceding power generator) and the outflow of the power generator.

Figure 2:
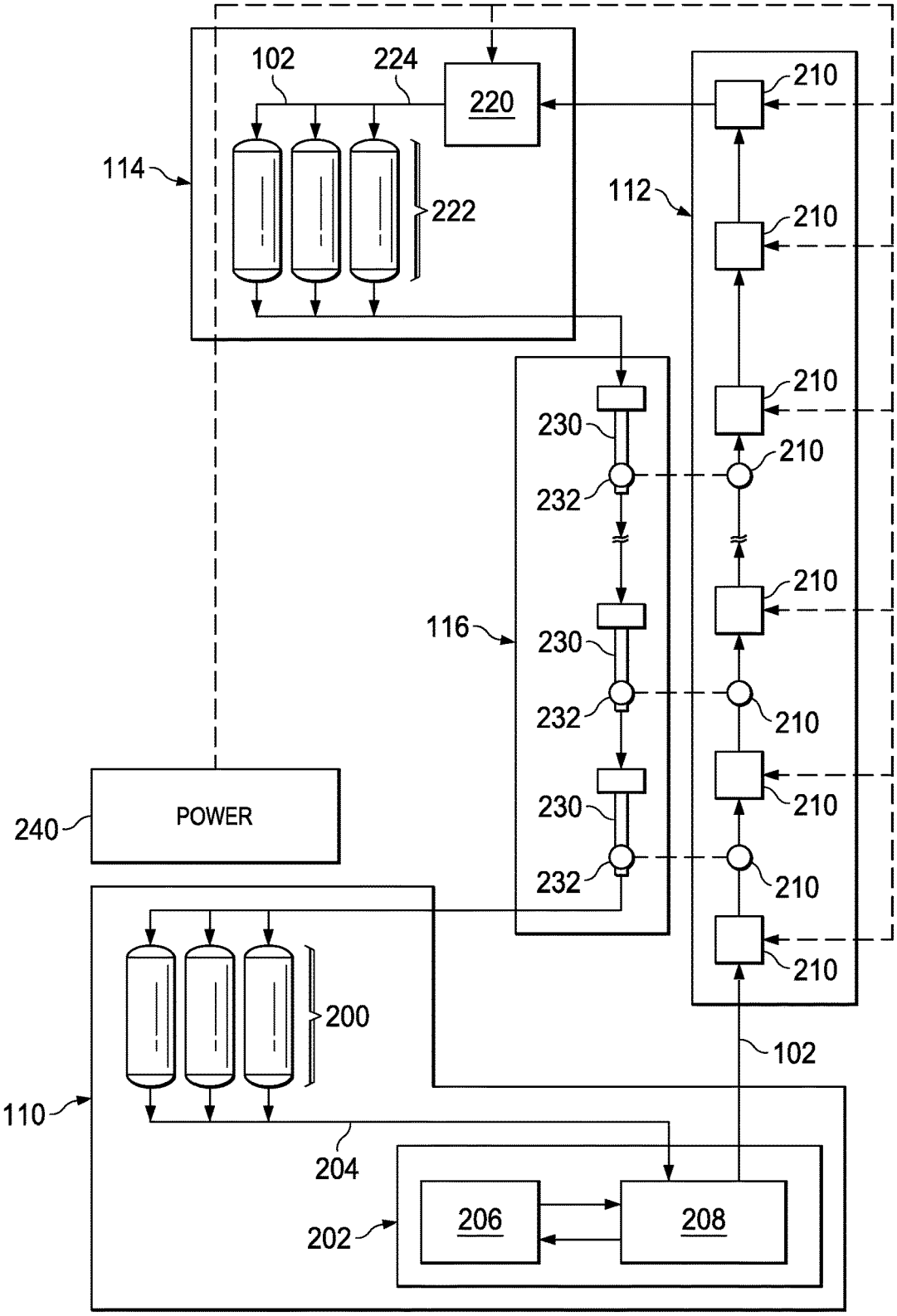
FIG. 2 is a schematic diagram illustrating additional details of the thermo-elevation plant of FIG. 1 in accordance with one aspect of the disclosure.

FIG. 2 illustrates additional details of the thermo-elevation plant 100 in accordance with one aspect of the description. In this aspect, waste heat from power generation stages 160 and/or some power is communicated to a plurality of lift stages 210 spaced along the elevation rise of the lift conduit 112 for reheating the working fluid 102 during the lift. The lift conduit 112 may comprise as many, more, or less lift stages 210 as the power generation conduit 116 has power generation stages 160. At the elevated plant 114, a condenser is used without a compressor. In other aspects, a compressor may also be used. In the power generation conduit 116, the working fluid 102 is not thermally treated prior to power generation. Working fluid 102 is recirculated.

Referring to FIG. 2, the base plant 110 comprises a plurality of store tanks 200 connected in parallel. The tanks 200 may be connected in series or otherwise suitably connected. The tanks 200 are connected or otherwise coupled to an evaporator 202 through piping 204. In one aspect, elements are connected by piping with control, check, expansion and other valves. A working fluid make-up may replace any working fluid loss.

The evaporator 202 comprises a heat plant, or source, 206 and a heat exchanger 208 configured to transfer heat from the heat plant to the working fluid 102 to transform it from a liquid or other state to a vapor, or gaseous, state. The heat plant 206 may comprise any suitable source such as a solar power, waste heat from a solar power generation plant, a thermoelectric plant, or carbon-based sources. In one aspect of the disclosure, the evaporator heat plant 206 may comprise direct and/or ambient heat. An example waste heat source 206 is described in more detail below in connection with FIG. 4.

The heat exchanger 208 heats the working fluid 102 through a boiler or other heat exchanging device. The heat exchanger 208 may receive heat from the heat plant 206 through a thermal loop circulating between the heat exchanger 208 and the heat plant. Example heat exchangers 208 are described in more detail below in connection with FIGS. 5-8.

The piping and other elements of the lift stages 210 may be insulated or uninsulated, pressurized or not pressurized and thermally treated or not treated. Insulation may be preferred to reduce heat loss and/or condensation of the vapor. In one aspect, the lift stages 210 may comprise low or lower pressures inside the upstream pipe with vapor pumps with thermal heaters reheating the vapor, or gas, to prevent condensation and pressures reaching critical pressure points.

The lift conduit 112 comprises a plurality of lift stages 210. In one aspect of the disclosure, the lift stages 210 may each comprise uprising piping, thermal elements such as heat exchangers to heat, including to reheat, or maintain the vapor state of the working fluid 102, and/or vapor, or gas, pumps to lift the working fluid 102 through successive lift stages 210 from the base plant 110 to the elevated plant 114. In one aspect of the disclosure, the vapor pumps may comprise fans or turbines configured to create a current to lift the working fluid 102 or other vapor movement or displacement devices. The lift stages 210 may comprise control, check and other valves for controlling working fluid 102 lift in the lift stages 210.

In one aspect of the disclosure, a subset of lift stages 210 may be configured to use solar and/or other energy to heat and lift the working fluid 102 as described in more detail below in FIG. 9. The remaining lift stages 210 may be configured to use waste heat and/or power from the power generation conduit 116 to heat and lift the working fluid 102 as described in more detail below in FIG. 10. The number, spacing and type of the lift stages 210 may vary based on lift elevation and working fluid 102 type.

The elevated plant 114 comprises a condenser 220 and store tanks 222. The condenser 220 receives the working fluid from the lift conduit 112 and condenses the working fluid for storage in tanks 222. An example condenser 220 is described in more detail below in connection with FIG. 11.

The tanks 222 may be connected in series or otherwise suitably connected. The tanks 222 are connected or otherwise coupled to condenser 220 through piping 224. In one aspect of the disclosure, elements are connected by piping with control, check, expansion and other valves. The working fluid 102 is held in tanks 222 until power generation is needed, at which time the working fluid is discharged or flowed to the power generation conduit 116.

The power generation conduit 116 comprises a plurality of power generation stages 230. In one aspect of the disclosure, the power generation stages 230 may each comprise down-piping, control and other valves and power generators 232 coupled together and configured to produce electrical power through the use of the gravitational force of flowing working fluid 102. The power generators 232 may comprise vertical hydropower generator units which, when configured or enabled to work with any working fluid 102, may be vertical hydraulic-power generator units. The vertical generator units comprise generators vertically elevated above the base of the thermo-elevation plant 100. The power generators 232 may comprise a turbine configured to be driven by the flowing working fluid 102 and, in turn, configured to drive an electric generator. In this aspect of the disclosure, the turbine converts the energy of flowing fluid into mechanical energy and the generator converts this mechanical energy into electricity. The number and spacing of the power generators 232 may vary based on elevation fall and working fluid 102 type. In one aspect, the length or fall of each power generation stage 230 may be based to limit or control load conditions placed on the generator. An example power generation stage 230 is described in more detail below in connection with FIG. 12.

In one aspect of the disclosure, a series of "tower tanks" may be provided in the power generation conduit 116, with a tank between every stage or between one or more stages. The tower tanks act like the city water towers and store and discharge working fluid 102 between power generation stages 230 and may act as forebay pulse penstocks.

When the working fluid 102 leaves the last power generator 232, it is temporarily stored in the storages tanks 200 of the base plant 110. The working fluid 102 may then be supplied back to the evaporator 202 for recirculation to repeat the (closed) cycle or, in some cases, discharged (open).

A solar power station 240 may be coupled to the lift conduit 112 and the elevated plant 114 to provide power for the lift stages 210 and/or the condenser 220, as well as associated equipment such as a compressor. Power may be otherwise supplied to the lift stages 210 and the condenser 220, and the solar power station may power other elements of the thermo-elevation plant 100.

Figure 3:
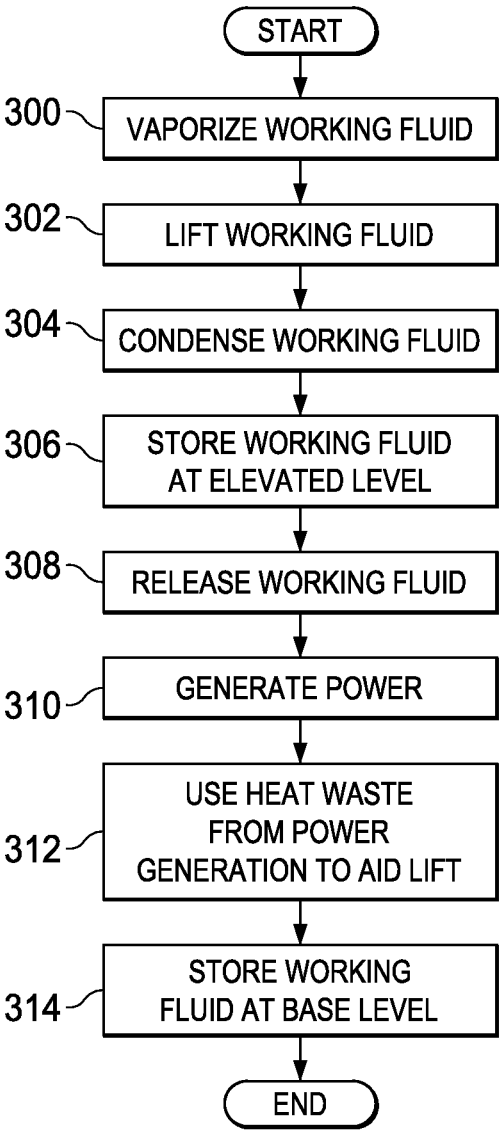
FIG. 3 is a flow diagram illustrating operation of the thermo-elevation plant of FIG. 2 in accordance with one aspect of the disclosure.

FIG. 3 is a flow diagram illustrating operation of a thermo-elevation power plant in accordance with one aspect of the disclosure. In one aspect, the method carries waste heat of a plant in a thermal fluid and exchanges the heat from the thermal fluid to a working fluid circulating in an elevated loop or circuit. The heated working fluid is lifted to an elevated level and power is generated using working fluid flowing from the elevated level. The working fluid may be lifted in sequential stages and power generated in sequential stages. The method may use plants and conduits as described in connection with FIG. 2 or use other suitable equipment. The plant may be operated, for example, continuously, periodically, during times of power demand, complementary to a solar plant to generate power during solar off-times, or in connection with a standard thermoelectric power station to provide thermal cooling while storing and/or generating electricity.

Referring to FIG. 3, the method begins at step 300 where working fluid is vaporized. The working fluid may be vaporized at a base level, which is lower in elevation than an elevated level. The base level may comprise elevation variation. The working fluid may be vaporized using heat from any suitable source such as waste heat from a solar plant, a thermoelectric plant, or industrial process. Other suitable heat sources, such as a heat plant and/or ambient temperature may be used without departing from the scope of the disclosure. For example, if the base level is situated in a desert or valley floor, high ambient temperature may be used to heat or vaporize the working fluid.

Next, at step 302, the working fluid in vapor form is lifted, or elevated. The elevation lift may comprise a hundred or hundreds of feet, many hundreds of feet, a thousand or thousands of feet, or many thousands of feet. In one aspect, the vapor may be lifted in stages with heat added to prevent working fluid condensation and/or mechanical lift devices.

At step 304, the working fluid may be condensed at an elevated level. Condensation may be done using ambient temperatures at the elevated level and/or with mechanical means such as, for example, coils and/or fans. In some aspects, condensation may be aided by compression depending on the working fluid.

At step 306, the condensed working fluid is stored at the elevated level. The elevated level is higher than the base level and may comprise elevation variation. The condensed, or liquid working fluid may be stored in tanks to be discharged when power generation is needed. The elevated storage tanks may store the working fluid for use during peak or other periods. If combined with a solar power station, the working fluid may be discharged from the elevated storage tanks for power generation after dark (night), on cloudy days, or otherwise to complement solar power production. If combined with a thermoelectric power station, the working fluid may be discharged continually or as needed to cycle fluid to provide cooling. Thus, energy may be stored in the thermo-elevation plant in the form of high-potential working fluid energy and used as needed.

Proceeding to step 308, the working fluid is released, or discharged for return to the base level. The working fluid may be flowed through power generators for power generation. The flow of working fluid may be controlled or metered from storage tanks and/or into the power generators.

At step 310, power is generated. In one aspect, the power generation may be in stages and use turbines connected to generators. Power generation may occur without any thermal treatment or heating of the working fluid after condensation and storage in the elevated tanks.

At step 312, waste heat may be fed back to the lift stages to heat the rising vapor. At step 314, the working fluid is stored at the base level for recirculation or discharge. Step 314 completes the method by which thermoelectric power station cooling may be provided, power may be generated and/or energy may be stored.

Figure 4:
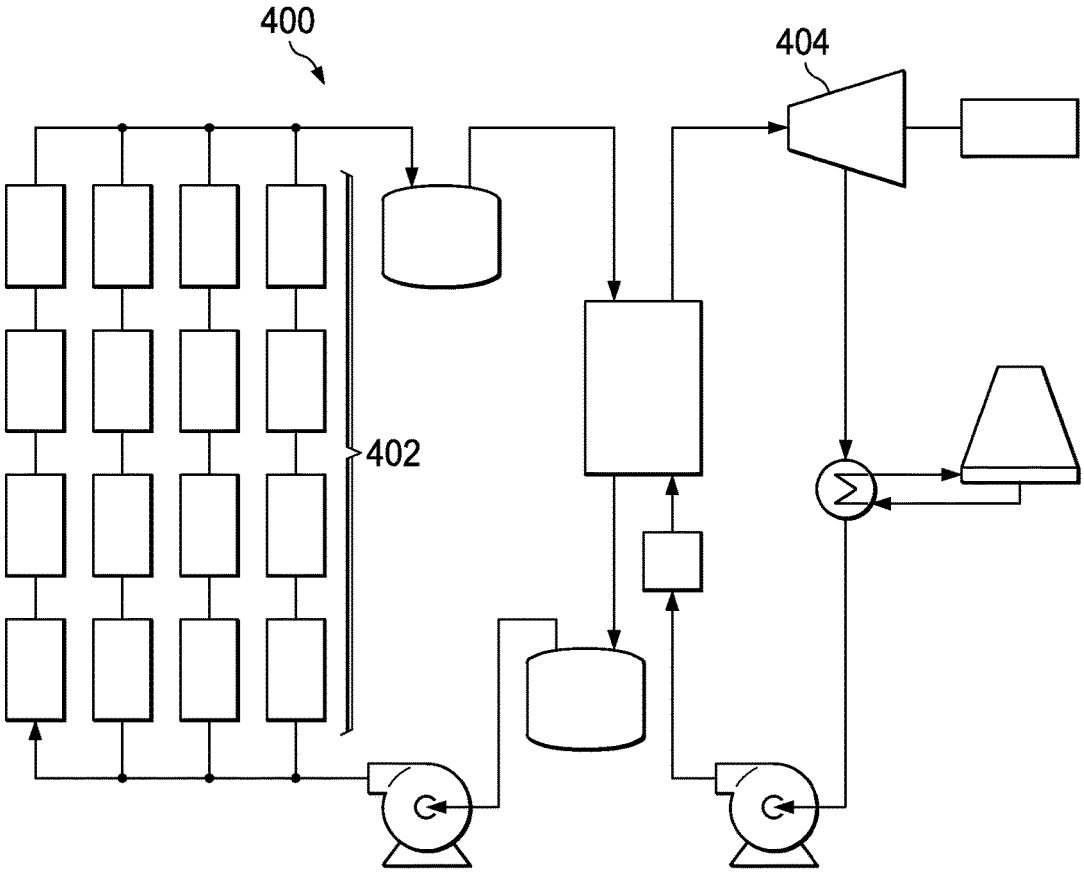
FIG. 4 is a schematic diagram illustrating a thermal plant of the base plant of the thermo-elevation plant of FIG. 2 in accordance with one aspect of the disclosure.

FIG. 4 illustrates a heat plant 400 of the base plant 110 in accordance with one aspect of the disclosure. The heat plant 400 may be attached to, otherwise connected or otherwise coupled to the evaporator of the base plant 110. In this aspect, the heat plant 400 comprises a solar power station with a solar array 402. Waste heat from the heat plant 400 may be carried via a thermal cooling loop and via one or more heat exchangers used to vaporize the working fluid 102. Thus, the vaporizer may act as a cooling system for the heat plant 400 and cool, for example, steam leaving the turbine 404 of the station. The heat plant 400 for which cooling is provided may be any thermoelectric power station or industrial or other process that generates waste heat.

Figure 5:
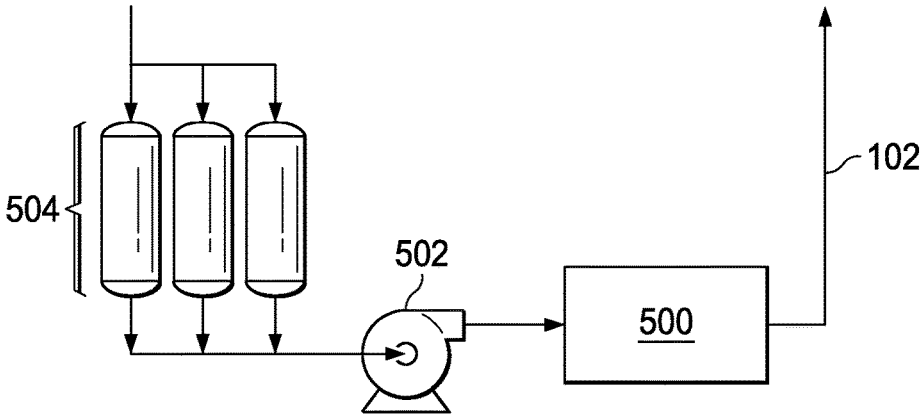
FIG. 5 is a schematic diagram illustrating an evaporator of the base plant of the thermo-elevation plant of FIG. 2 in accordance with one aspect of the disclosure.

FIG. 5 illustrates an evaporator 500 of the base plant 110 of FIG. 2 in accordance with one aspect of the disclosure. Referring to FIG. 5, working fluid 102 may be vaporized using direct solar heating at evaporator 500. In this aspect, the working fluid 102 may flow or be pumped with pump 502 from base tanks 504 to a direct solar heater and after vaporization flow to a lift conduit.

Figure 6:
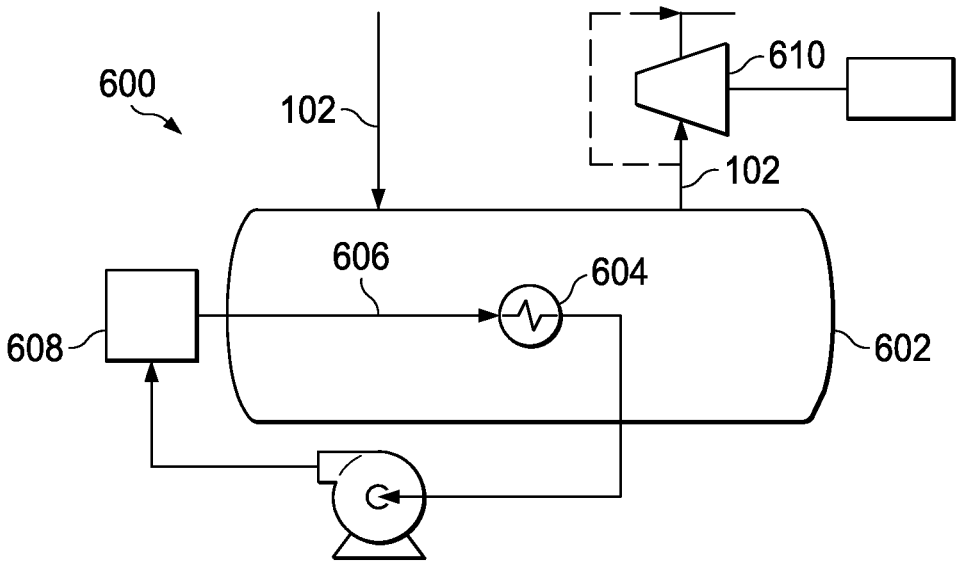
FIG. 6 is a schematic diagram illustrating an evaporator of the base plant of the thermo-elevation plant of FIG. 2 in accordance with one aspect of the disclosure.

FIG. 6 illustrates an evaporator 600 of the base plant 110 of FIG. 2 in accordance with one aspect of the disclosure. Referring to FIG. 6, the evaporator 600 comprises a solar boiler 602. The solar boiler 602 comprises a heat exchanger 604 through which a solar heated fluid 606 is circulated from a solar plant or station 608 to heat and evaporate the working fluid 102 in the solar boiler 602. Any suitable heat plant may alternately or in combination be used, such as, for example, a thermoelectric plant or a direct (solar) steam generator.

From the solar boiler 602, the working fluid 102 may flow directly to a lift conduit or flow through a secondary turbine 610 configured to drive generator 612 and produce additional power. The additional power may be used in the base plant, the lift conduit or some other element of a thermo-elevation plant.

Figure 7:
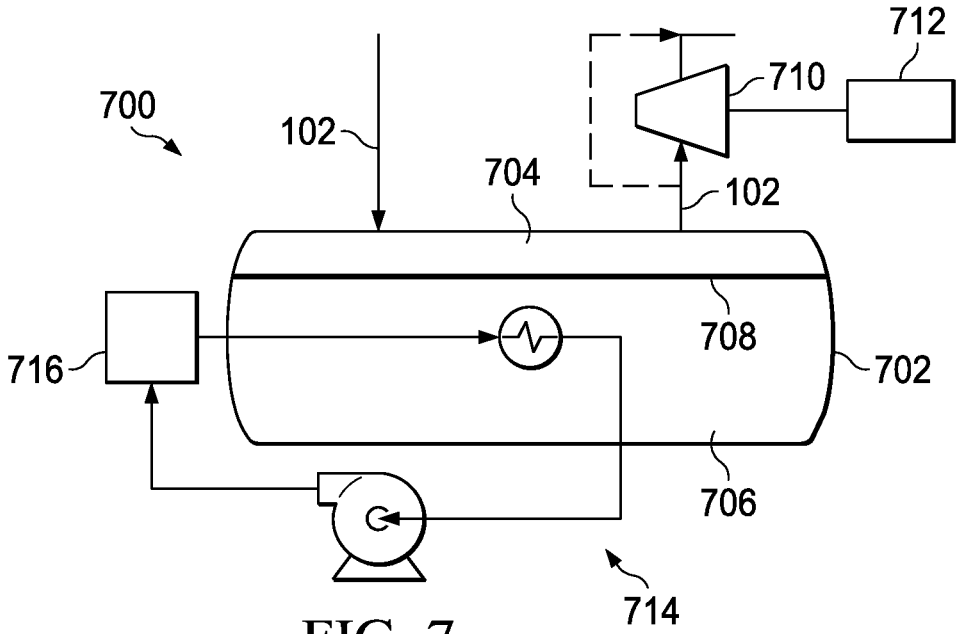
FIG. 7 is a schematic diagram illustrating an evaporator of the base plant of the thermo-elevation plant of FIG. 2 in accordance with one aspect of the disclosure.

FIG. 7 illustrates an evaporator 700 of the base plant 110 of FIG. 2 in accordance with one aspect of the disclosure. Referring to FIG. 7, the evaporator 700 comprises a heat exchanger 702 configured to evaporate the working fluid 102 and manage or control the temperature of the working fluid 102. In this aspect, the heat exchanger 702 may comprise two chambers 704, 706 divided by a heat sink/heat exchange 708. The bottom chamber 706 may absorb and distribute high heat and act as a heat control to prevent decomposition of working fluid 102. The top chamber 704 contains the working fluid 102. The heat exchanger 702 may, in addition to vaporizing the working fluid 102 and/or being the steam/vapor source, drive a secondary turbine 710 coupled to a generator 712 to generate additional power.

A thermal circulation loop 714 may be configured to circulate heat, for example, a hot liquid fluid, between a thermoelectric station 716 and the heat exchanger 702. The thermoelectric station 716 may be a heat plant such as described in connection with FIG. 4.

Figure 8:
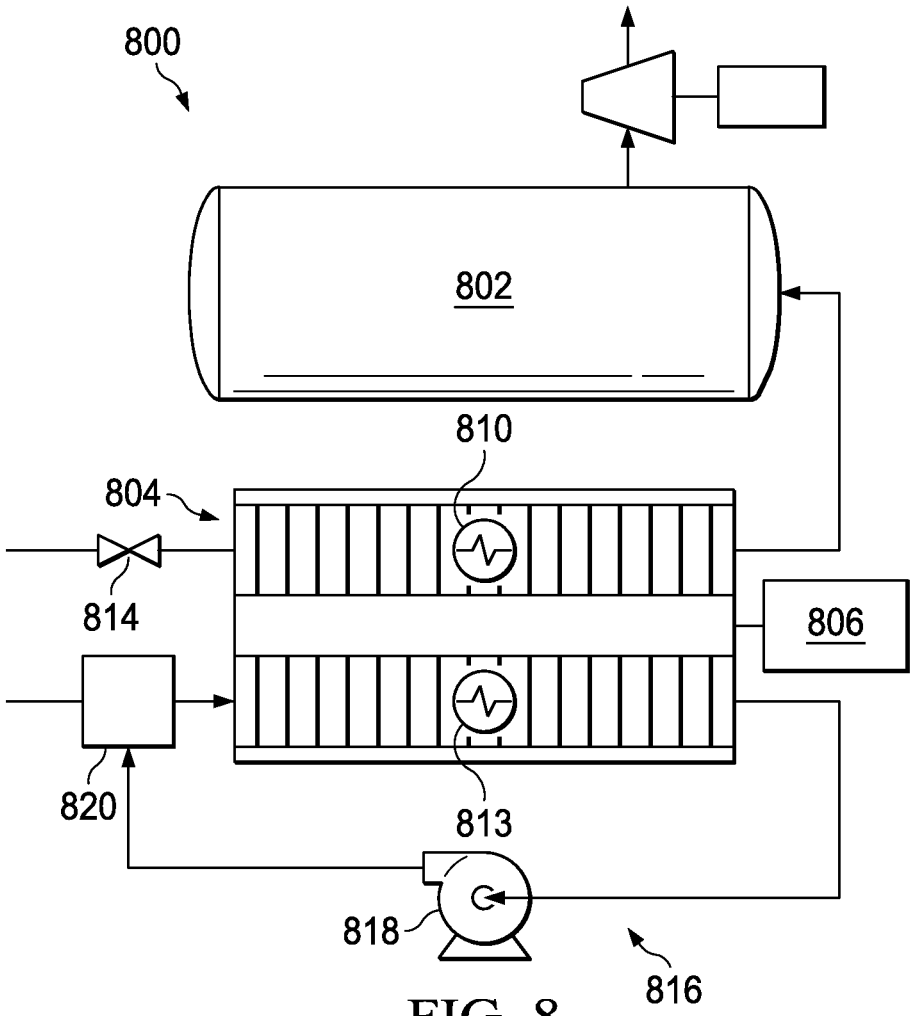
FIG. 8 is a schematic diagram illustrating an evaporator of the base plant of the thermo-elevation plant of FIG. 2 in accordance with one aspect of the disclosure.

FIG. 8 illustrates an evaporator 800 of the base plant 110 of FIG. 2 in accordance with one aspect of the disclosure. In this aspect, a Stirling engine/turbo expander/heat exchanger may be used to convert liquid gas to compressed gas. A Boese motor cycle with a turbine maybe used as a turbo expender.

Referring to FIG. 8, the evaporator 800 may comprise a pressurized tank 802 and a Stirling engine 804 coupled to a generator 806 to generate power. The Stirling engine 804 may comprise a first heat exchanger 810 and a second heat exchanger 813 that drive the generator(s) 806. The first heat exchanger 810 may comprise a cold side of the Stirling engine 804 with a working fluid 102 source in liquid compressed-gas form flowing initially through an expansion valve 814 and then the heat exchanger 810 to absorb heat and vaporize. The heat exchanger 813 is hot with a hot source such as a thermal cooling loop of a plant, which will increase efficiency of the Stirling engine. Ambient temperature may be used.

The heat exchanger 813 is coupled to a thermal circulation loop 816 which pumps with pump 818 or otherwise circulates heat between a thermoelectric power station 820 and the heat exchanger 813. The thermoelectric power station 820 may be a heat plant such as described in connection with FIG. 4.

Figure 9:
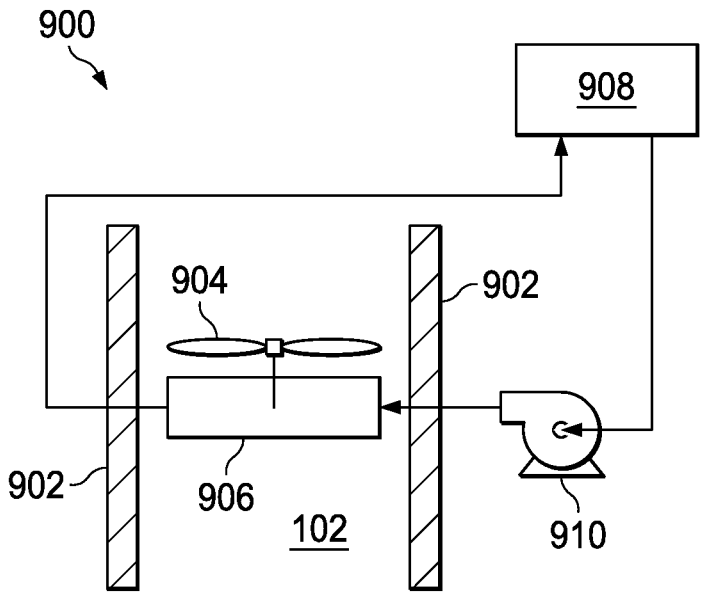
FIG. 9 is a schematic diagram illustrating a lift stage of the lift conduit of the thermo-elevation plant of FIG. 2 in accordance with one aspect of the disclosure.

FIG. 9 illustrates a lift stage 900 of the lift conduit 112 of FIG. 2 in accordance with one aspect of the disclosure. Referring to FIG. 9, the lift stage 900 comprises a pipe 902 carrying the working fluid 102 and a vapor pump 904, such as a fan, for moving the working fluid 102 upwards in the pipe 902. A heat exchanger 906 provides heat or thermal energy to the working fluid 102 to keep it from condensing in the pipe 902. The heat exchanger 906 may be coupled to a solar heater 908 through piping and a pump 910. The solar heater may comprise a concentrated solar power (CSP) unit.

Figure 10:
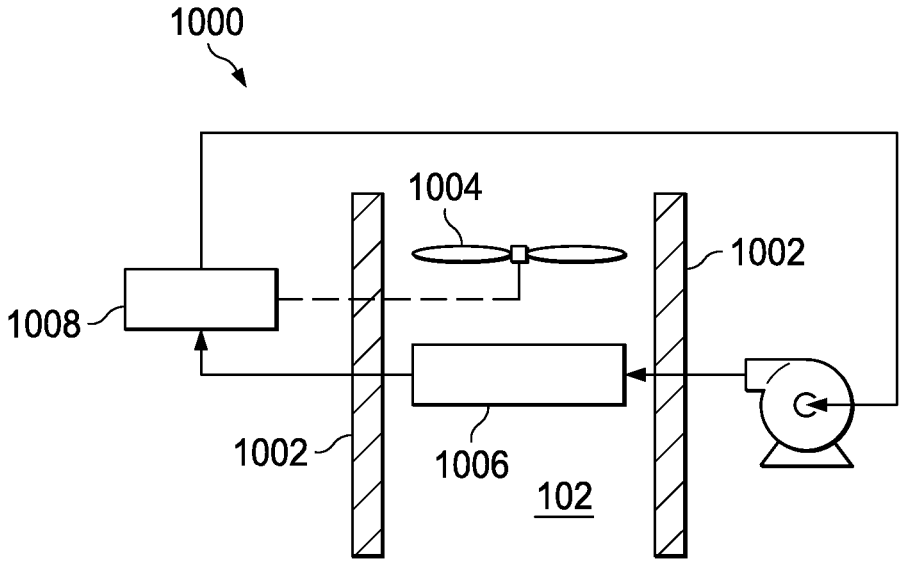
FIG. 10 is a schematic diagram illustrating a lift stage of the lift conduit of the thermo-elevation plant of FIG. 2 in accordance with one aspect of the disclosure.

FIG. 10 illustrates a lift stage 1000 of the lift conduit 112 of FIG. 2 in accordance with one aspect of the disclosure. Referring to FIG. 10, the lift stage 1000 comprises a pipe 1002 carrying the working fluid 102 and a vapor pump 1004, such as a fan, for moving the working fluid 102 upwards in the pipe 1002. A heat exchanger 1006 provides heat, or thermal energy to the working fluid 102 to keep it from condensing in the pipe 1002. The heat exchanger 1006 may be directly or otherwise coupled to a power generator 1008 to receive and/or use waste heat (the ohmic heating/resistive heating) from the generator for heating the upstream pipe 1002, especially if low temperature working fluid 102 is used. In this aspect, there may be two heat exchangers, a first inside the upstream pipe 1002 and a second inside the electric generator of the hydro, or hydraulic, power generator 1008. Some of the hydro, or hydraulic, power (hydro turbine power) may be used to run the fan 1004. The resistance of the electrical generator coils (resistance heat) in the power generator 1008 may be adjusted to gain additional heat inside the upstream pipe 1002.

Figure 11:
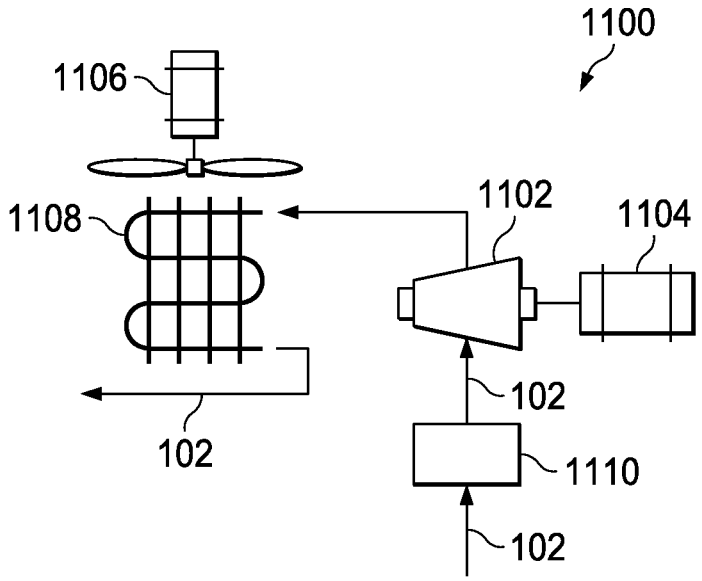
FIG. 11 is a schematic diagram illustrating a condenser of the elevated plant of the thermo-elevation plant of FIG. 2 in accordance with one aspect of the disclosure.

FIG. 11 illustrates a condenser 1100 of the elevated plant 114 of FIG. 2 in accordance with one aspect of the disclosure. In this aspect, a compressor 1102 is coupled to the condenser 1100 and configured to compress the working fluid 102 to aid the condenser 1100. The compressor is coupled to and driven by motor 1104.

Referring to FIG. 11, when the working fluid 102 reaches the compressor 1102, the condensation process starts. The compressor 1102 compresses the working fluid 102 vapor, such as steam, and the condenser 1100 converts the hot compressed working fluid to a liquid, such as steam to water. The condenser 1100 may comprise a cooling fan 1106 and coils 1108. In one aspect, a Stirling engine may be provided between the compressor 1102 and the condenser 1108 to generate extra energy from waste heat of the compressor to run auxiliary devices. In another aspect, a heat exchanger 1110 may also be provided before the compressor to pre-cool the working fluid 102 before compression. Such a heat exchanger may use ambient temperatures.

Figure 12:
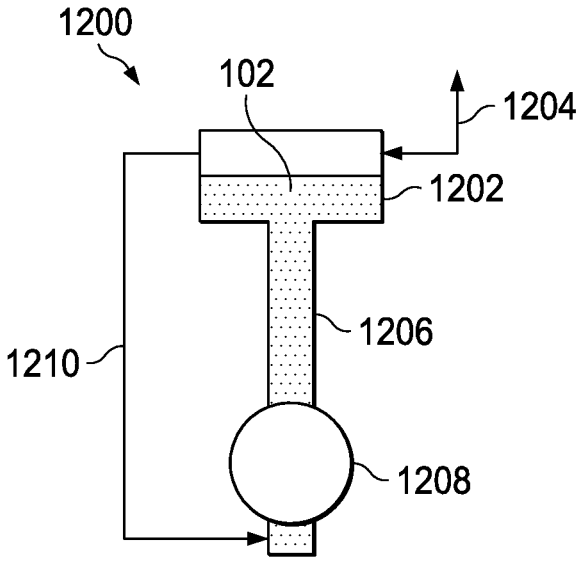
FIG. 12 is a schematic diagram illustrating a power generation stage of the thermo-elevation plant of FIG. 2 in accordance with one aspect of the disclosure.

FIG. 12 illustrates a power generation stage 1200 of FIG. 2 in accordance with one aspect of the disclosure. Referring to FIG. 12, the power generation stage 1200 comprises an intake basis, or tank, 1202 with pressure equalization 1204 to control fluid volume and/or flow, a penstock 1206, a hydro, or hydraulic generator 1208, and an overflow 1210.

Gravity causes the working fluid 102 to fall or flow through the penstock 1206. At the end of the penstock 1206 a turbine propeller of the generator 1208 is configured to be turned by the moving fluid. Power lines are connected to the generator 1208. The working fluid 102 continues past the turbine to a next power generation stage.

A number of embodiments of the invention have been described. Nevertheless, it will be understood that various modifications may be made without departing from the spirit and scope of the invention. Accordingly, other embodiments are within the scope of the following claims.

What is claimed is:

1. A thermal elevation system, comprising:

a base plant comprising an evaporator configured to vaporize a working fluid to a vapor state;

a lift conduit comprising a plurality of lift stages, each lift stage configured to lift the working fluid in the vapor state;

an elevated plant higher in elevation than the base plant, the elevated plant comprising a condenser configured to condense the working fluid from the vapor state to a liquid state; and a power generation conduit comprising a plurality of power generation stages, each power generation stage configured to generate electrical power using working fluid in the liquid state down-flowing from the elevated plant to the base plant;

wherein each of the plurality of the lift stages is coupled to corresponding each of the plurality of the power generation stages, each of the coupled plurality of lift stages configured to use waste heat generated from thermal fluid by each corresponding plurality of the power stages for heating the working fluid in the plurality of the lift stages.

2. The thermal elevation system of claim 1, further comprising each of the plurality lift stages comprising a thermal heater to heat the working fluid in the vapor state.

3. The thermal elevation system of claim 1, wherein the plurality of the lift stages each comprising:

a thermal heater to heat the working fluid in the vapor state; and a vapor pump to move the working fluid upwardly in the lift conduit in the vapor state.

4. The thermal elevation system of claim 1, the working fluid comprising a fluorocarbon.

5. The thermal elevation system of claim 1, further comprising the plurality of the power generation stages each coupled to the corresponding lift stage, the plurality of the power generation stages each configured to provide the waste heat from the thermal fluid to the corresponding coupled lift stage to heat working fluid in the coupled lift stage.

6. The thermal elevation system of claim 1, further comprising a Stirling engine coupled to a cold source of the evaporator and a hot source of the evaporator, the Stirling engine configured to transfer heat between the cold source and the hot source and to generate power.

7. The thermal elevation system of claim 1, the evaporator comprising an expansion valve.

8. The thermal elevation system of claim 1, the evaporator comprising a heat exchanger coupled to a thermal circulation loop configured to cool a thermoelectric plant and the working fluid, the heat exchanger configured to transfer heat from the thermal circulation loop to the working fluid.

9. The thermal elevation system of claim 1, the condenser comprising a coil and a fan configured to condense the working fluid.

10. The thermal elevation system of claim 1, the elevated plant further comprising a compressor coupled to the condenser and configured to compress the working fluid to aid condensation in the condenser.

11. The thermal elevation system of claim 1, the plurality of the power generation stages each comprising:

a penstock coupled to an inlet tank; and a power generator coupled to the penstock; and the power generator comprising a turbine configured to be driven by flowing working fluid fed by the penstock and an electric generator coupled to the turbine, the electric generator configured to be driven by the turbine to generate electricity.

12. The thermal elevation system of claim 6, the cold source comprising the working fluid and the hot source comprising a thermal circulation loop configured to cool a thermoelectric plant.

13. A power generation station, comprising a thermoelectric power plant configured to generate electricity, a thermal elevation system coupled to the thermoelectric power plant, the thermal elevation system comprising:

a base plant comprising an evaporator coupled to the thermoelectric power plant, the evaporator configured to transfer the heat from a thermal fluid circulating between the thermoelectric power plant and the thermal elevation system to a working fluid circulating in the thermal elevation system;

a lift conduit coupled to the evaporator, the lift conduit configured to lift the working fluid to an elevated plant;

the elevated plant coupled to the lift conduit, the elevated plant comprising a condenser operable to condense the working fluid; and a power generation stage coupled to the elevated plant and to the base plant, the power generation stage configured to generate power from the working fluid flowing from the elevated plant, further comprising a plurality of the power generation stages each coupled to a corresponding lift stage, the power generation stages each configured to provide waste heat from thermal fluid to the corresponding coupled lift stage to heat working fluid in the corresponding lift stage.

14. The power generation station of claim 13, further comprising:

the lift conduit comprising the plurality of the lift stages each comprising a heater to heat the working fluid in the lift conduit; and a power generator conduit comprising the plurality of the power generation stages.

15. The thermal elevation system of claim 13, the working fluid comprising a fluorocarbon.

16. The thermal elevation system of claim 13, the base plant further comprising a Stirling engine, the Stirling engine coupled to a working fluid source and a thermal circulation loop source, the Stirling engine configured to transfer heat between the thermal circulation loop source and the working fluid source to generate power.

* * * * *